US006200406B1

(12) United States Patent
Ito

(10) Patent No.: US 6,200,406 B1
(45) Date of Patent: Mar. 13, 2001

(54) METHOD AND AN APPARATUS FOR MANUFACTURING SIDE WALL OF A CUP FOR CUPPED CAKE

(76) Inventor: Sadaharu Ito, 30-5 1-Chome, Saginomiya Nakano-Ku, Tokyo-to (JP)

( * ) Notice: Subject to any disclaimer, the term of this patent is extended or adjusted under 35 U.S.C. 154(b) by 0 days.

(21) Appl. No.: 09/049,034

(22) Filed: Mar. 27, 1998

(51) Int. Cl.[7] ..... B31B 49/00

(52) U.S. Cl. ..... 156/250; 156/510; 264/571; 264/152; 264/175; 264/335; 264/295; 264/339; 425/290; 425/291; 425/366; 425/388; 425/437

(58) Field of Search ..... 156/242, 244.11, 156/245, 250, 510; 264/138, 152, 175, 571, 335, 295, 339; 425/290, 291, 327, 335, 404, 388, 366, 437

(56) References Cited

U.S. PATENT DOCUMENTS 5,506,046 * 4/1996 Andersen et al. .
5,580,409 * 12/1996 Andersen et al. .
6,126,584 * 10/2000 Zadravetz .

FOREIGN PATENT DOCUMENTS 9-94896 * 4/1997 (JP) .

* cited by examiner

*Primary Examiner*—Mathieu D. Vargot
(74) *Attorney, Agent, or Firm*—Oblon, Spivak, McClelland, Maier & Neustadt, P.C.

(57) ABSTRACT

A method of forming a side wall of a cupped cake cup at high speed, including paying off a paper sheet through a plurality of paying off rolls; cutting a blank off the paper sheet with a paper cutter disposed at least one of normal and oblique to a direction in which the paper sheet is fed; immediately before or after the cutting, applying a sealing agent; supplying the blank to a specified roll gap formed between a forming cone roll and a holding cone roll capable of rotating in opposite directions; performing shaping, cutting and sealing works on the blank during one rotation of the forming and holding cone rolls, wherein the blank is made into the side wall of the cupped cake cup; separating the side wall of the cup from the forming cone roll; and guiding the side wall of the cupped cake cup in the axial direction of the forming cone roll.

16 Claims, 13 Drawing Sheets

METHOD AND AN APPARATUS FOR MANUFACTURING SIDE WALL OF A CUP FOR CUPPED CAKE

TECHNICAL FIELD

This invention relates to a method of forming paper cups and a production apparatus for manufacturing the aforesaid cups. More particularly it relates to a method and an apparatus for continuously supplying a paper for making a cup which is not cut to be supplied to a roll gap between a pair of conical continuously rotating rolls and pasting them at the timing and the place which varies depend on the kind of sealing material and then cutting it as a blank for making one cake cup and then forming it as a bottomless hollow frusto-conical side wall and introducing it towards a forwarding ends of a pair of small diameter forming ends.

BACKGROUND ART

Fifty to two hunded of thus shaped side walls are supplied as a unit and stacked together according to the prior art, and a bottom plate formed by the prior art is inserted, then the side wall and the bottom plate are joined by a pasting or the like as a finished cup. This method and apparatus can also be used for making a cup using a blank previously cut into a fan shaped configuration. Heretofore, a side wall of the cup has been formed by using a cup side wall shaping machine as illustrating by FIG. 12. This side wall shaping machine is composed of a pair of wings 9 and 9' capable of being moved slightly upwards and downwards about a connecting pin 7 along the groove 8, a pair of swingable pin 15 and 15 are disposed at the outer side portions between the outer ends of swingably movable end and the inner end movable around the connecting pin 7, the swingable pins 15 are also placed at each of the two top points of the operating rods 30 and 30; A slider 20 and an urging rod which urges these wings 9 upwards and downwards as a whole and moves the urging rod 6 disposed at the upward end of the connecting rod 21 to move the blank 1 is mounted between the end connected by the pin 7 and the other free end, swingable pins 15 are opened or closed by the operating rod 21 and a slider 20 which pushes the blank 1 against a frusto-conical shape, hereafter it can be referred only to a cone roll or a cone 4; Operating rods 30 which push said pair of wings 9 and 9' to open or close in a harmonized manner:

As rolled paper for making the cups is cut into each fan shaped size as a blank and is supplied to a side wall shaping machine not shown. Next, the blank 1 supplied to the lower face of the cone roll 4 is further pushed by a pusher member 6, then the blank is further pushed between the two inner faces 22 of each of the swings 9 having the same convexed face as the concaved outer face of cone roll 4 and is further clamped between two faces and is further sealed as a frusto-conical cup. Then wings 9 and 9' are opened to send the completed cup having thus shaped frusto-conical shape to its axially small diameter side and the next blank to be worked as a next cup is set ready for supplying to the lower part of said cone roll 4 and thus one cycle can be finished.

Sealing of the Pasting Portion of the Formed Cup

Heretofore, a sealing of a formed cup has been conducted using a sealing agent noted below. As a sealing agents there are three kinds of sealing agents, such as, glue seal, hot-melt seal, heat seal of laminated hot melt seal, and these method using three kinds of sealing will be explained hereafter.

Glue Sealing

Glue is a water solution of alpha ($\alpha$) starch. Since it is applied before it is sealed and is dried in natural air at the time for drying and solidifying and this differs depend upon the concentration thereof and requires some extent of drying, and therefore the capacity of cup making is restricted by the kind of glue to be used.

Hot Melt Seal

Since the interfacial tension of the thermally plastic resinous material to the paper is small, therefore such kind of glue is used which is liable to adhere to the paper and having strong adhesion power to the paper after cooling. In order to make easier the sealing operation, several kinds of synthetic resinous materials are selected to mix them to lower the thermal fusion temperature and to increase the sealing strength. For example, polyethylene having high adhesion force at about 120° C. to the paper, and paraffin having lower adhesion force having thermally softening temperature of 60–80° C. are selected to mix them to satisfy the required sealing agents. Generally, sealing agents formed as pellet shape or as a string shape is fused into liquid state by using fusing apparatus attached to the gun and applied to a portion by means of springs or compressed air.

Heat Sealing by Means of Laminated Polyethylene

This sealing agent is made on a mass production scale by using an equipment as mentioned below, so it is able to apply a thin film of polyethylene over the entire surface of the paper material of the cup. FIGS. 13(A) and (B) depict a side view and a front view of the production equipment of the polyethylene paper, and there is a rolled polyethylene laminated paper is supplied on the upper surface thereof fused thin film of polyethylene 63 by an electro-thermal fuser 64 named as a T die disposed above it when it passes through a polyethylene extender 62 consisting of a pair of rolls 62*a* and 62*b* spaced parallel at a desired spacing. The paper 61 covered with a thin film of fused polyethylene film 63 are fed as a one body of polyethylene adhered film 65 and is wound around a winding roll 66 disposed around down stream side. In this manner, if a paper adhered with polyethylene film of 15 $\mu$ (micron) is heated for adhesion, then polyethylene is melted and a seal where polyethylene is confronting face to face with each other would be made consolidated, however, these bodies will immediately solidify upon removal of heat source. For papers of general purpose use which is not covered with coating agent for increasing their printing effects or with aluminum foil bonding for improving decoration effects, is required to place such adhesion improving agents. For compacting sealing or overlapped type sealing, polyethylene which solidifies upon removal of heat source is used for adhesion.

Properties of Each of the Sealing Agents

1)Heat Resistant Property

If the cake is worked above 150° C., glue only is selected. For the cake of steamed type both a glue and a polyethylene laminated paper (120° C.) are used and it is determined that whether they should be used depends on the quantity of the paraffin to be used.

2) Water Proofing Property

Since polyethylene is strong in water proofing property, it can be used for cups for storing drinks and hot melted raw material is strong enough for storing water, however, from the view point of its price it is impossible to cover all the surface of the paper. Glue is poor in water resistancy.

3)Workability of Coating and Sealing

Polyethylene>Glue>Hot melt

4) Prices

Glue is lowest and hot melt is most expensive while polyethylene is placed between the two.

(1) Shaping of the Side Wall and the Apparatus to be Used for

As already mentioned, a pair of wings and a pair of cone rolls are combined together for utilizing an up and down motion and right and left wing motion to make paper for cups, which is lower in strength and is liable to be broken more easy as compared with metal plates, to wind up around a cone roll using reciprocating open and shut down motion. There is a limit for repeating opening and shutting motion and there is a need to feed a paper for cups to be supplied previously formed and cut as a fan shaped blank. So it has been desired that a method and an apparatus for making side walls of paper cups with higher speed can be provided, because the former apparatus have drawbacks that they were poor in high speed operation, complicated construction, high wear ratio and poor in productibility. Upto the present, if the cup is top sealed type as for the cone cup of ice cream, it has been possible to make a cup by winding a cup around the outer surface of the cone rolls and blowing air from the large diameter opening side after the cup has been sealed. However, normally the side walls of the paper made cup for cakes is formed its small diameter side cut as hollow frusto-conical bottomless shape, so if one tries to blow air to transport it to another place the wind only passes through the interior of the cup and is not enough to act as a force to transport it. If one makes a frusto-conical shaped cup with a cone roll type apparatus, he cannot propel it to a next portion and receive the next blank to be formed there, that is, feeding of paper, forming it to a cup, removal of the formed cup and feeding of the next blank were not continuously repeated, and these reasons have prevented from high speed production of frusto-conical cup side walls using rotating cone rolls.

1) Sealing by Glue

When supplying sealing agent to a paper to be sealed, it is considered very easy since, due to natural air drying, no heating or pressurising, once glue is applied to the paper it only requires some length of time for evaporating its water content, in addition, if it becomes fully dried by heating the adhesive force may be lost, so it is necessary that a slight extent of water is kept retained. Depending on some working condition, artificial heating may be used. Adhesion of pasting portion must be considered carefully as to how to carry out the pasting.

2) Sealing by Hot Melting Material

Thermally fusing hot melting material and supplying it to a paper to be sealed while it is not cooled and solidified, it is troublesome since it is required to establish means and method to maintain it not solidified until it fully adheres to the paper to be used.

3) Laminated Polyethylene

The price of polyethylene as raw material is lowest among plastic resinous materials to be used and is easy for handling and it is ready for operation since it adheres to the paper only by blowing hot air of about 300 ° C., and further it immediately solidifies after stopping a hot air blast. Sealing by glue and hot melt can be made by applying sealing material only for the portion to be sealed, but the method of sealing by laminated polyethylene paper and laminated polyethylene are applied by adhesion roll and then cooled, so it is required to apply on the all surfaces of the paper, but the polyethylene has large water proofing and heat resistant property it has been desired for use as drink cups from the point of production speed and its efficiency.

SUMMARY OF THE INVENTION (1) A Method of Forming Side Wall

1) A method of forming side wall according to the present invention is basically cutting a forward end portion of the continuously fed paper at perpendicular or oblique angle as a one piece of the cup blank, and feeding it to the roll gaps of two rolls which are placed perpendicular to or obliquely set to the direction of the feeding direction of the paper in response to the cutting operation, and cutting off the surplus portion above and lower part of the cup and complete as a side wall, next cuts it just same as it has been in the previous motion to separate it from the cup paper. This cutting is done also for the first time cutting of the next cup.

2) Alternatively, a blank is cut out as a fan shaped blank from the first time and the thus cut out blank is fed to a roll gap formed between a forming roll and a depressing roll.

3) The method as outlined in the 1) and 2) mentioned above, each of the forming roll and the holding roll has the same inclination angle to their side line parallel with each other and are closed to only one roll gap but the depressing roll is spaced apart from its position to the forming roll, and further the side wall of the cup finished its forming is separated from its forming roll by air evacuation and then send to the stacking portion by an air transportation means. At the time when the cup side wall has finished its forming work, it is fed to its stacking station, and the depressing cone roll is fed back to its approached position to the forming cone roll and ready for waiting next operation. In this manner the whole apparatus are rotated by repeating the action of approaching and separation.

4) At a part of the peripheral surface of the cone roll, several numbers of holes for sucking out and exhausting air are opened to make a one line plane with the axial line, and these holes are rendered to come to the most approached position when the tip end of the blank is fed to the forming roll and the depressing roll, and these holes are sucking the air to hold the blank around the periphery of the cone roll and begins to form the side roll.

5) If a continuous blank sheet is used for subsequent cutting, it cut off the forward tip end of the blank with its slitter attached to the tip end of the smaller side end of the forming roll, and cuts off the upper end of the blank with an upper end cutter attached to the backward end of the depressing roll. When the first cutting is correctly done, cutting by the upper end cutter is not needed, and if petal-like or wavy top portion is shaped it must be formed by a petal-like or wavy cutter.

6) By the rotation of two cone rolls, a blank for the side roll is wound and both the forward tip end and the rearward tip end are overlapped together and then sealed by a bonding agent such as a glue or the like and is completed by sealing. Such sealing would be explained later.

7) When sealing is finished, the depressor is moved sideways from the forming roll while it is rotating, at this time the holes used for suction are changed into exhausting and the air is blown out to separate the sealed side wall from the forming cone roll and send it towards its small diameter side and send pressurized air from the auxiliary air nozzle and send the sealed side wall around the guide post at the forward tip end of the former and send it to the stacking apparatus mentioned later.

8) Next, a blank for next operation is placed able to be supplied and the one cycle of side wall operation is finished.

(2) Sealing of Sealed Portion.

1) According to the present invention by feeding a paper and cutting the forward tip end of the paper to make it to form a blank, it is possible to make a blank by sending a tip end of the blank to be wound later to be coincide with the side end portion, then this side end portion is always become a one side end of the cup and it can be cut one after another and this portion can be utilised as a sealing portion to be sealed. Applying sealing agent while the paper is feeding and cutting the paper as soon as the side wall has been finished. And this cutting is done perpendicular to the feeding direction or parallel to the side end of forward portion of the fan shaped portion scheduled to be fed.

2) At the time when the cutting is finished, one side of the paper where sealing agent is not applied begins shaping by wounding about the former cone roll while the other portion of the paper where sealing agent is applied is wound about the former cone roll at the last stage, and at the last moment where the former cone roll has finished its one turn forming work of the side wall. At the moment when both the upper end and the lower end of the side wall have been finished, sealing of both the upper end and the lower end of the blank is finished. Immediately after this moment, the sealed side wall is separated from the former cone roll and air is fed to the smaller diameter side of former roll.

3) When the previously cut blank is fed to the cone rolls, the side of the blank wound around the cone roll earlier is rendered to be a sealing portion not applied with a sealing agent and the other opposite portion is applied with sealing agent. Since this case, the blank has been cut into a fan shaped cutting of the upper end and the lower end is not necessary.

4) Glue can be used for baking cake and glue hot melt and laminated polyethylene can be used for this purpose, however, when low melting point paraffin is added the quantity of the paraffin should be limited. Container for containing drink water and other liquid contents are received, it should be limited to laminated container and relying on the method of rolls for using fused polyethylene films, and it must be relying on the polyethylene laminated film on the entire surface.

5) In case where the punched out blanks into a desired shape is used and the method of using cone roll of the present invention is also used, 50–200 of these blanks are vertically stacked on the stacker and they are sucked and fed by one sheet after another by a suction pipe. In performing the work, one side margin of the blank is rendered to be parallel to the direction of feeding and the other tip end portion must be placed parallel to the approaching line of the cone rolls. When glue is used as a sealing agent, the water should be applied at a distance in front of the place where it can be dried while the sealing agent is hot melt, it should be placed immediately before the place where the blanks could be wound around the cone roll, and if necessary, send hot air to finish adhesion by one rotation of the cone roll. As stated above, the method of high speed cup making and the apparatus for carrying out the method as stated above have been developed.

DETAILED DESCRIPTION OF THE INVENTION

The present invention relates to a method of and an apparatuses for making paper cups as stated above and as shown in FIG. 1 to FIG. 11.

Figure 1:
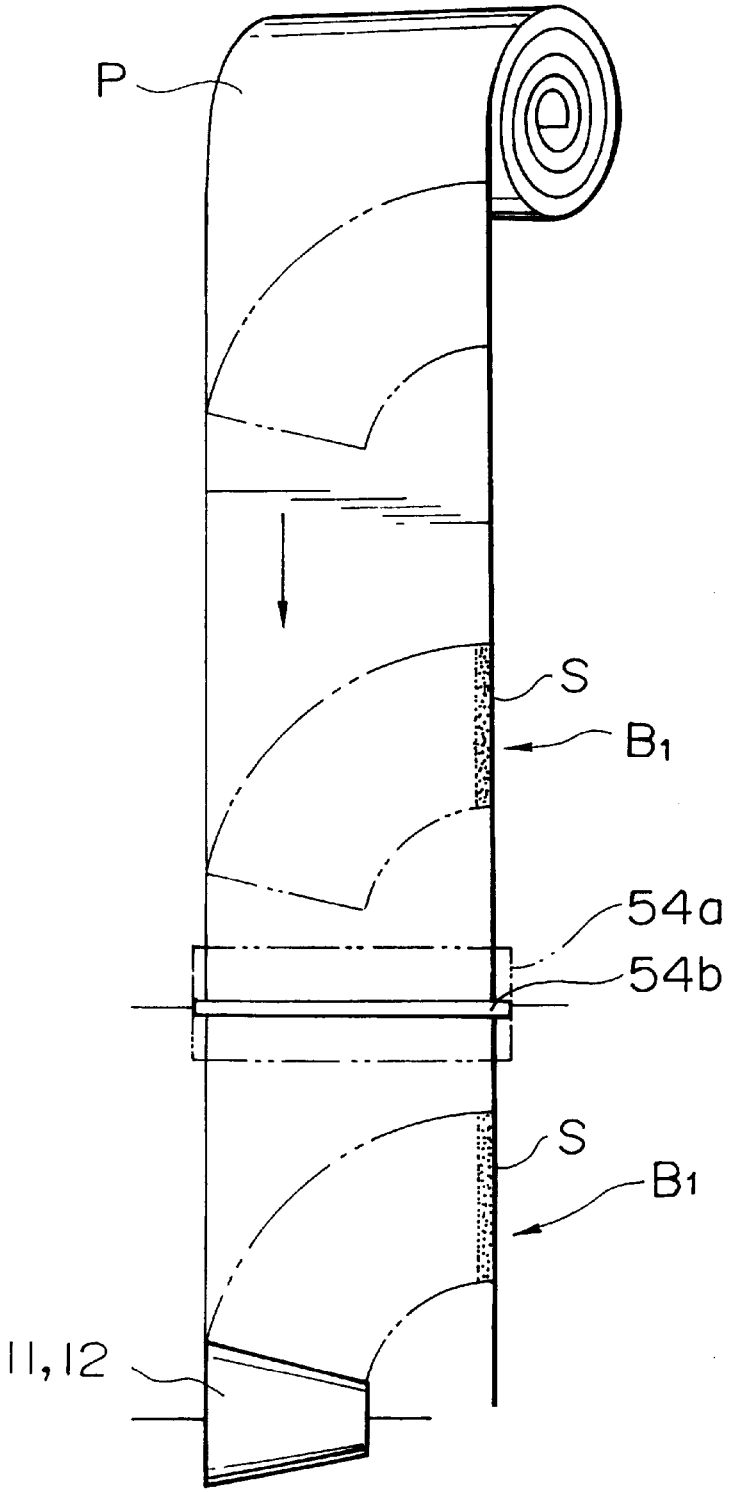
FIG. 1 is a perspective view showing a cutting process of a side blank from a paper stock according to the present invention.
Figure 2A:
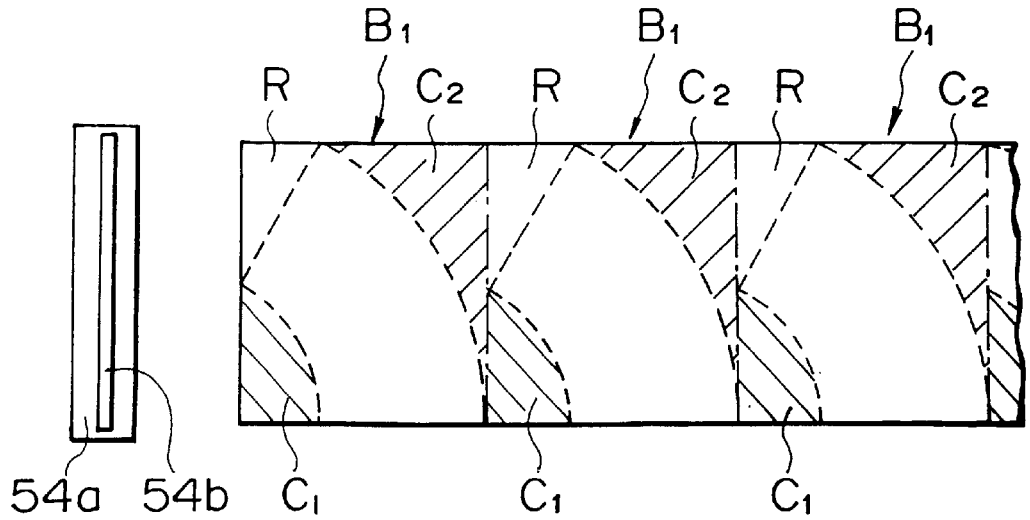
FIG. 2(A) is a plan view showing a cutting method of a paper stock according to the present invention.
Figure 2B:
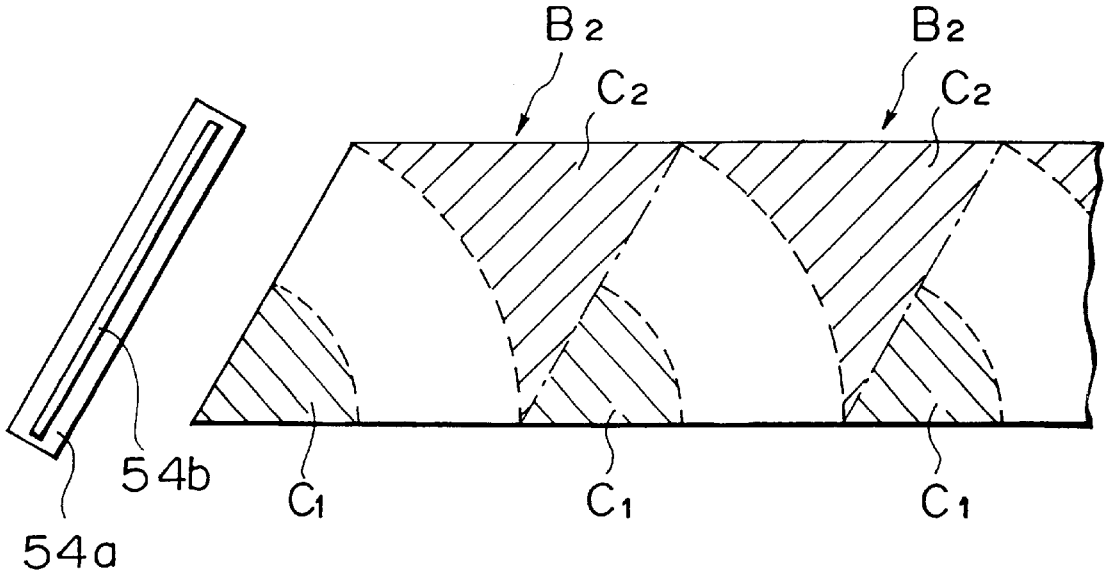
FIG. 2(B) is a plan view showing another cutting method of a paper stock according to the present invention.
Figure 3:
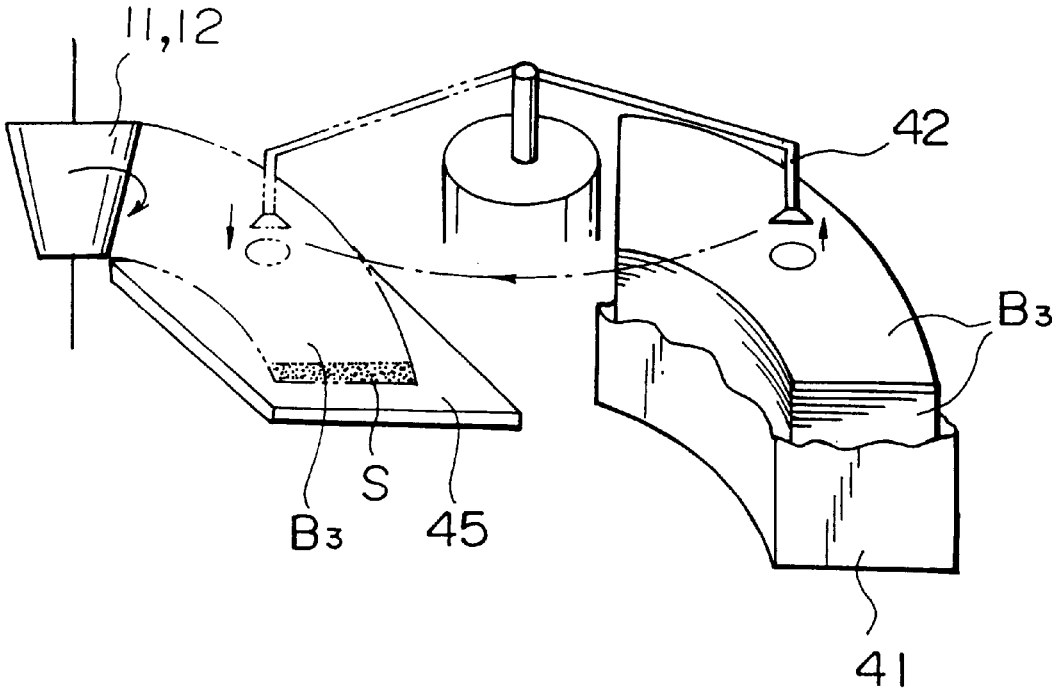
FIG. 3 is a perspective view showing a method of storing and transferring blanks previously cut into a fan shape according to the present invention.
Figure 4A:
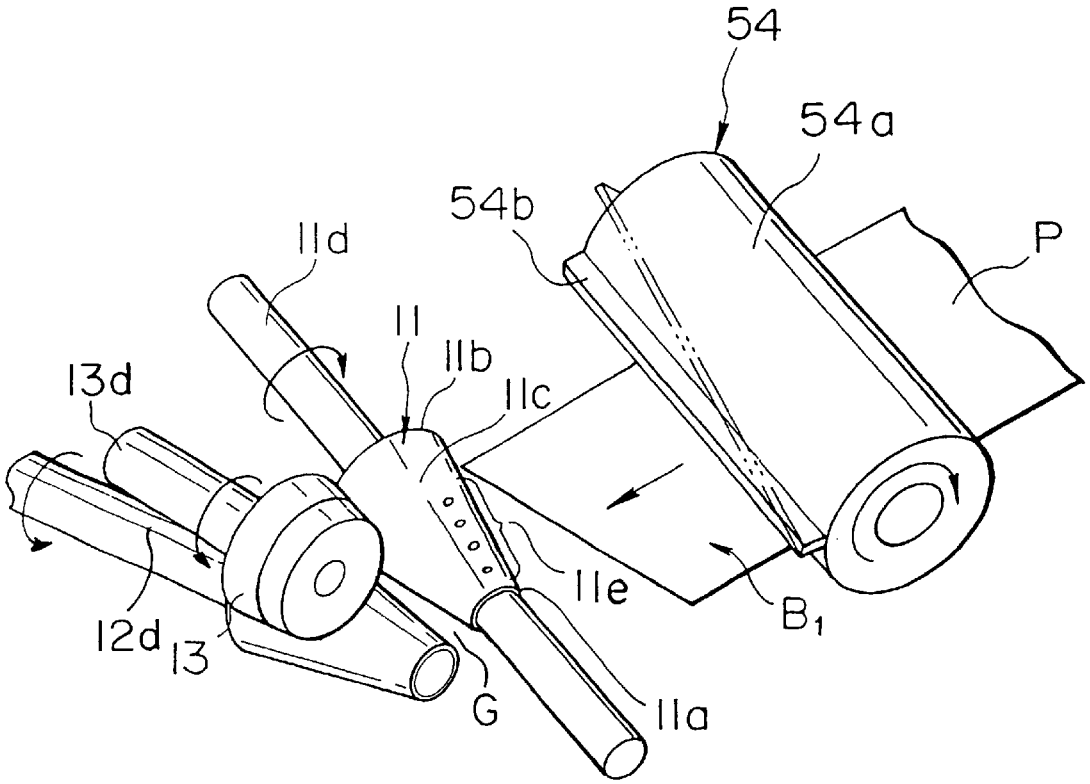
FIG. 4(A) is a perspective view showing an initial sequence of a process for forming a side wall of a cupped cake cup according to the present invention.
Figure 4B:
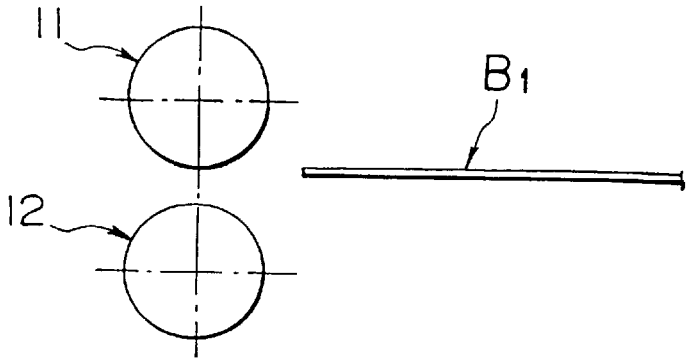
FIG. 4(B) is a side view showing the relation between the forming and holding cone rolls and a blank during the initial sequence shown in FIG. 4(A)

(1) As shown in FIG. 1, rolled paper material P to be used for making cup is fed in the direction as shown by an arrow mark in the drawing and the paper cutter 54*b* attached to the rotatable roller 54*a* is placed in the direction perpendicular to the apparatus, alternatively, it can be made as shown in FIG. 2(B) to cut the paper in the slanted direction to the $B_1$, $B_2$ and $C_1$, $C_2$ discarded as chips. This can be explained in the respective case to show that it can be done by comparing the size of $B_1$ or $B_2$ to be still used as a blank, the size of $C_1$, $C_2$ discarded as chips and as a part of R to be wound about as a part of a cup. FIG. 3 shows a case where the paper used for making a cup is previously cut into a fan shaped blank $B_3$ by another cutting machine, and 50 to 200 of the cut blanks $B_3$ are stacked on a blank stacker 41 and the thus stacked blanks $B_3$ are sucked on a supply tray 45 one after another and is pasted with glue on one side of the blank and then fed to the roll gap (G) between the forming cone roll 11 and the holding cone roll 12 as shown in FIG. 4(A) and 4(B). In this instance, the blank has already been cut off, the slitter 12*e* for cutting off the tip end and the cutter 13 stated later are not necessary. FIGS. 4(A) and (B) are figures showing a paper blank B1 cut by the cutter 13 is placed normal to the feeding line as shown by arrow mark and is fed between the roll gap (G) between the forming cone roll 11 and the holding cone roll 12 as shown by FIG. 4(A). Immediately before supplying the paper, holding cone roll 12 is separated from the forming cone roll 11 as shown by FIG. 4(B). These cone rolls 11 and 12 have their side peripheral surface 11*c* and 12*c* the same inclination angle to the common central axis, and their small diameter side edge of 11*a* and 12*a* and large diameter side edge of 11*b* and 12*b* are placed in the same direction and each axis line placed in the same plane and their peripheral surface 11*c* and 12*c* are placed near and are rotated in opposite directions. As shown in FIG. 4(A), on the side peripheral surface 11*c* of the forming cone roll a plurality of sucking and exhausting holes 1*e* are provided in alignment and these holes are opened from the central axis to the side peripheral surface 11*c* of the forming cone roll 11*c*. A guide post 14 is attached on the small diameter edge of the forming cone roll and is extended further from the small diameter end to the axial direction. And this guide post 14 plays an important roll to transport the finished cup by air to the stacking station as explained in the step mentioned later.

Figure 5A:
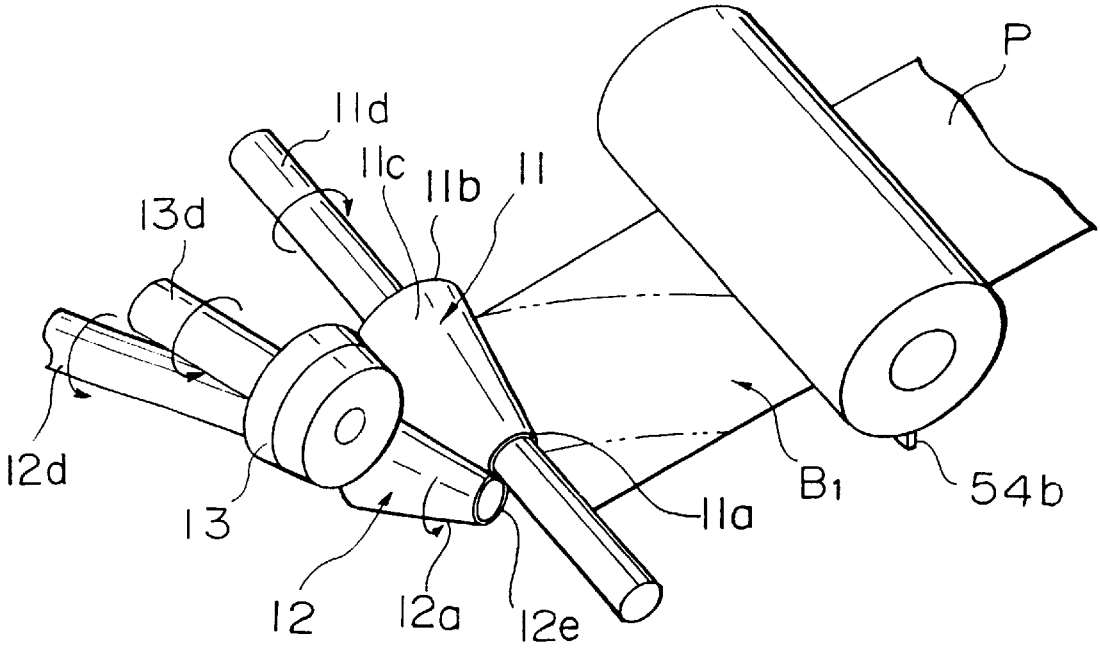
FIG. 5(A) is a perspective view showing a sequence following the initial sequence of the process shown in FIG. 4(A)
Figure 5B:
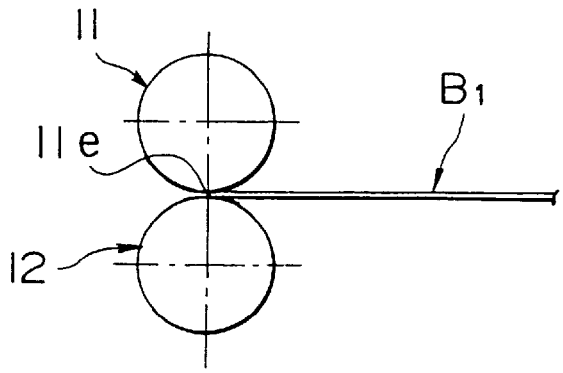
FIG. 5(B) is a side view showing the relation between the forming and holding cone rolls and the paper blank during the sequence shown in FIG. 5(A)

(2) As shown in FIG. 5(A), when the forward end of the blank $B_1$ cut out from the paper for making cups is supplied parallel to the gap between the forming cone roll and the holding cone roll, the holes for sucking and exhausting air are placed just at the approached position of the both cone rolls 11 and 12 and suck the blank $B_1$, and hold it by the holding cone roll 12 and wind up the blank $B_1$ by the side peripheral surface 11*c* of the forming cone roll 11. When the paper for making cup is supplied to the place between the holding cone roll and the forming cone roll, the holding cone roll 12 is placed near closed to the forming cone roll 11 to open the gap almost the same as the thickness of the paper as shown by FIG. 5(B).

Figure 6A:
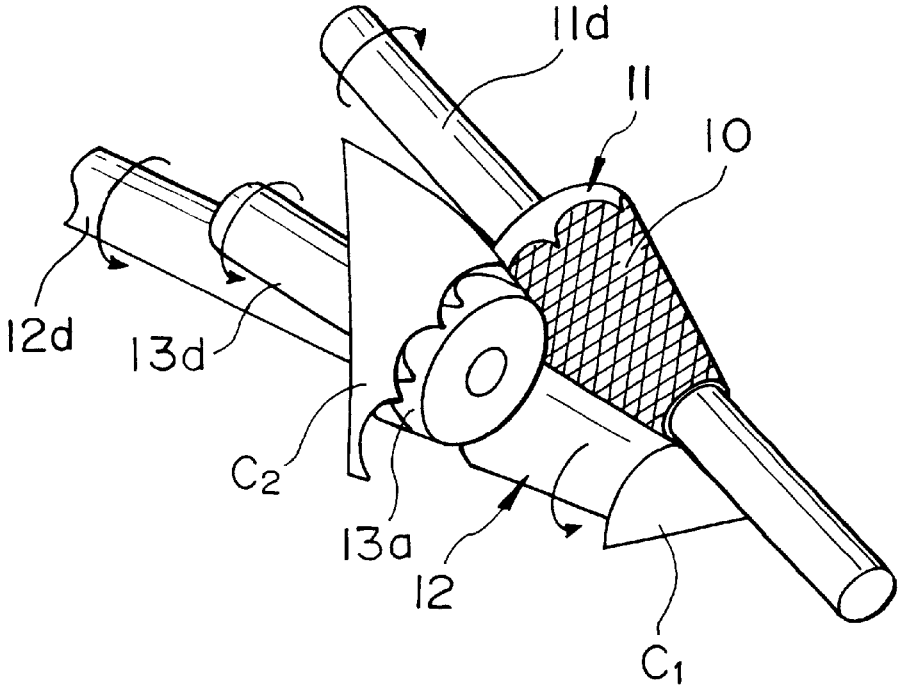
FIG. 6(A) is a perspective view showing a sequence following the sequence shown in FIG. 5(A)
Figure 6B:
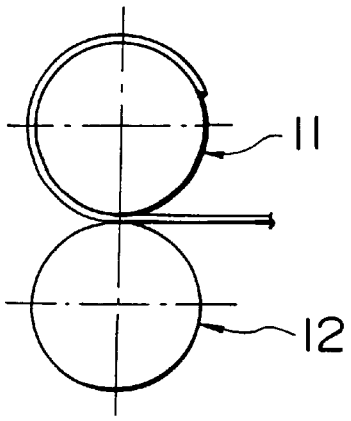
FIG. 6(B) is a side view showing the relation between the forming and holding cone rolls and a paper blank during the sequence shown in FIG. 6(A)

(3) As shown in FIG. 5(A), a portion of the blank wound around the outer part to be made as the forwarding tip end of the blank, is cut by the cutter 12*e* attached to the tip end of the small end side of the blank, and the two cone rolls are rotated, while the surplus portion is exhausted as lower chip $C_1$ as shown in FIG. 6(A). Just at the same time when the small diameter end side of the cup 10 is cut off, the holding cone roll 12 is rotated in reverse direction by another rotating shaft 12*d*, and then the portion to be made as upper part of the side wall of the cup is cut by the upper end portion 13 cutter pushed against near the upper end portion 11*b* of the side wall 10. If any decorative petal like configuration is desired to be formed on the upper part of the cup, such petal like configuration is cut by a cutter 13*a* as shown in FIG. 6(A). By means of this device upper tip portion $C_2$ is formed from the blank $B_1$ as shown by FIG. 6(B). Under this condition, holding cone roll 12 is held near to the forming cone roll 11 and continue its rotation.

Figure 7A:
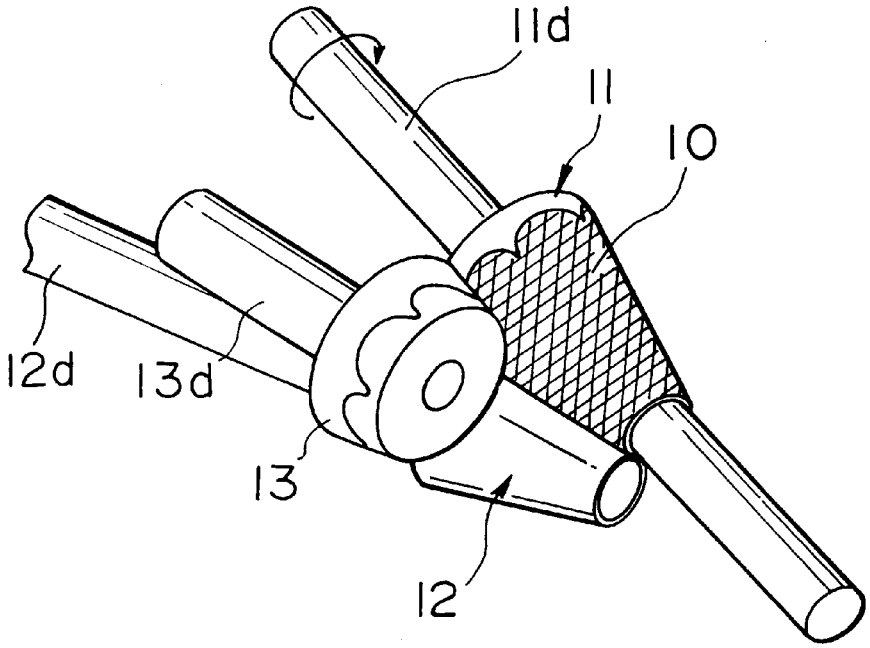
FIG. 7(A) is a perspective view showing a sequence following the sequence shown in FIG. 6(A)
Figure 7B:
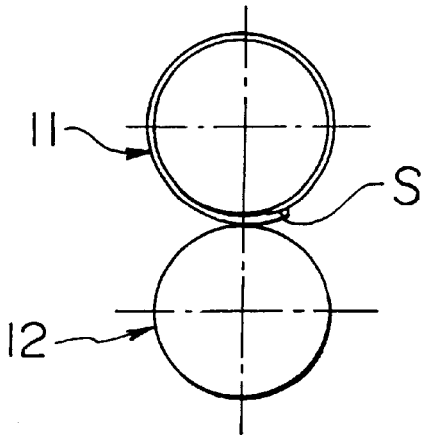
FIG. 7(B) is a side view showing the relation between the forming and holding cone rolls and a paper blank during the sequence shown in FIG. 7(A)

(4) Both cone rolls 11 and 12 rotate their own one rotation and their forward and rearward portions of the blank cut off from the blank are overlapped about the desired pasting portion S as shown by FIG. 7(B) and the both opposite ends of the wound blank as cut around are pasted together by laminated polyethylene hot air pasting, glue or hot melt pasting as shown by FIG. 7(A) and (B). FIG. 7(A) shows that a pasting portion where a side wall 10 of the cup is wound around the forming cone roll 11 with its pasting portion secured, under this condition both cone rolls are maintained in approached position and its slantedly hatched crossing portion shows its decorative pattern printed on the side surface of wall 10. As to the pasting of the pasting portion S explanation will be made later by referring to the FIGS. 10 to 11.

Figure 8A:
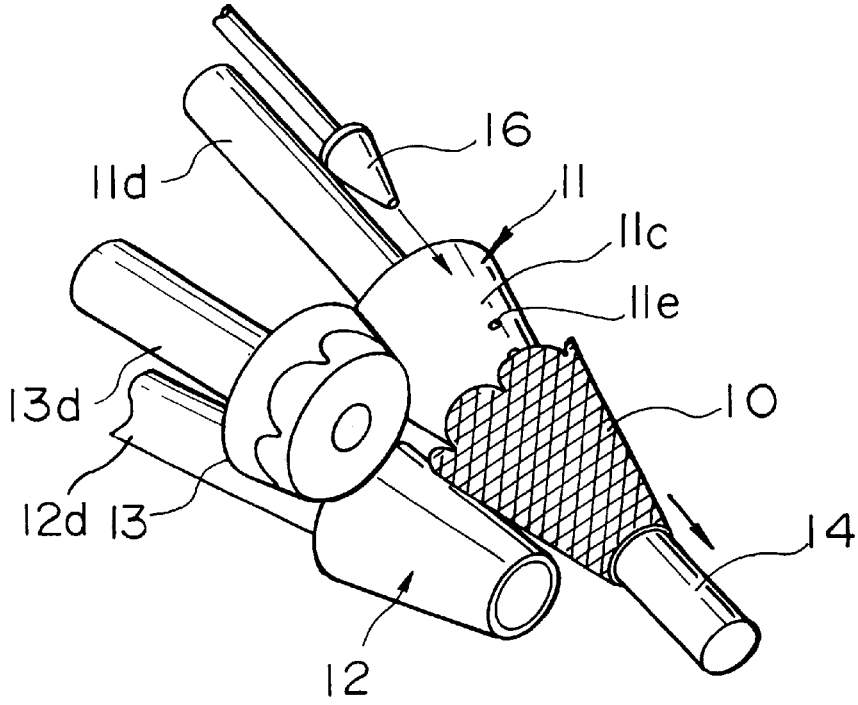
FIG. 8(A) is a perspective view showing a sequence following the sequence shown in FIG. 7(A)
Figure 8B:
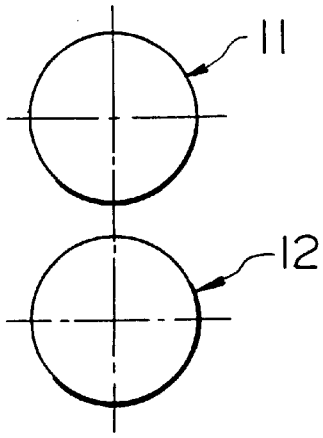
FIG. 8(B) is a side view showing the relation between the forming and holding cone rolls and a paper blank during the sequence shown in FIG. 8(A)
Figure 9A:
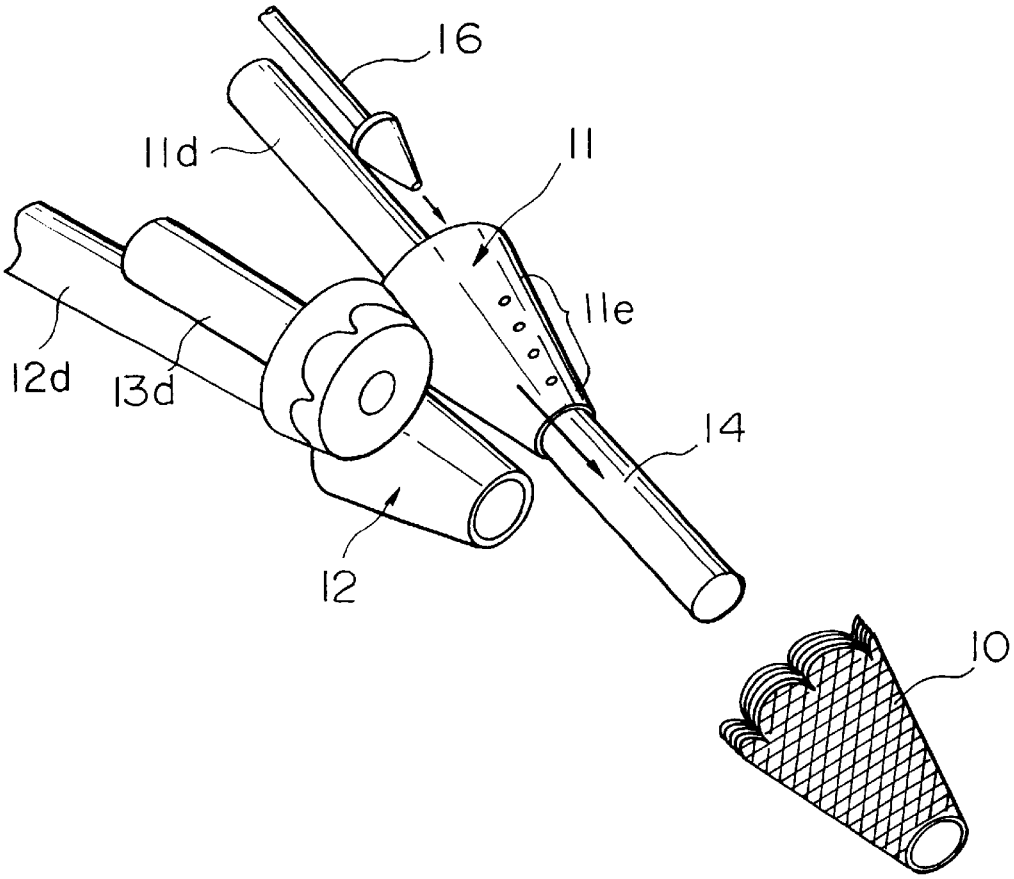
FIG. 9(A) is a perspective view showing a sequence following the sequence shown in FIG. 8(A)
Figure 9B:
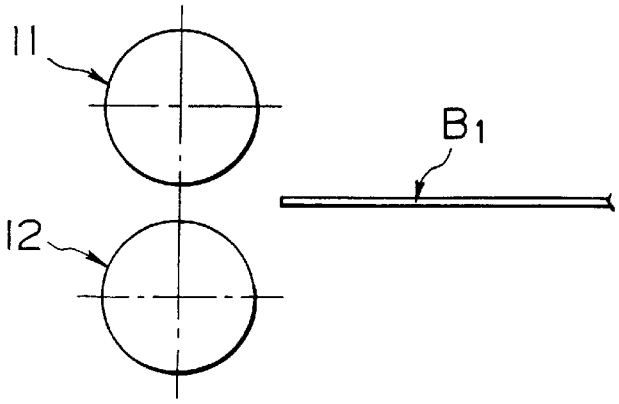
FIG. 9(B) is a side view showing the relation between the forming and holding cone rolls and a paper blank during the sequence shown in FIG. 9(A)

(5) FIG. 8(A) shows that the both cone rolls 11 and 12 are separated while they are rotated, suction and exhausting hole 11*e* appeared on the upper surface of the forming roll is changed to its exhausting side, and thus the side wall 10 finished its cutting tip end portion of the bottom and the cutting is separated from the tight contact with the forming cone roll 11 and is moved to its forward end of smaller side end. At the same instance, an air is blown from the auxiliary air nozzle 16, positioned between the rotary shaft 11*d* and said side surface of the forming cone roll 11*c*, towards the small diameter side 11*a*. By this air blowing, side wall 10 of the cup released from the contact with the forming cone roll 11 is pushed forward as shown in the arrow mark along the guide post 14 attached to the tip end portion of the forming cone roll 11, and the number of side walls 10 successively formed is advanced to the further forward portion as shown by FIG. 9(A), and 50 to 200 of the thus finished cups are sent to the stacking portion and they are sent to the cake making shop or to the assembly shop where they are assembled with the bottom portion. Under this condition, the holding cone roll 12 is separated from the forming cone roll 12 thereby finish their one cycle of finishing the side wall forming operation as shown by FIG. 8(B) and then a blank next $B_1$ to be supplied next is supplied.

Figure 10:
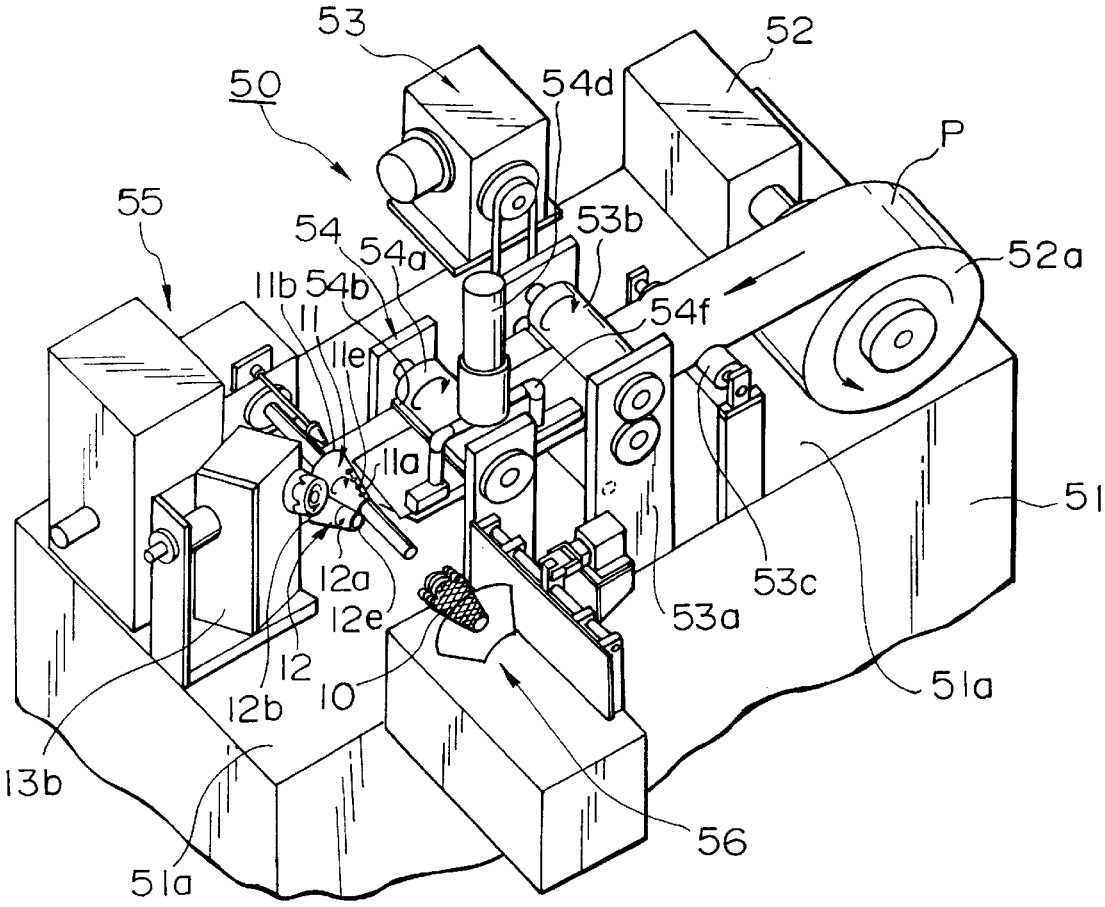
FIG. 10 is a perspective view showing an apparatus for forming a side wall of a cupped cake cup according to the present invention.
Figure 11:
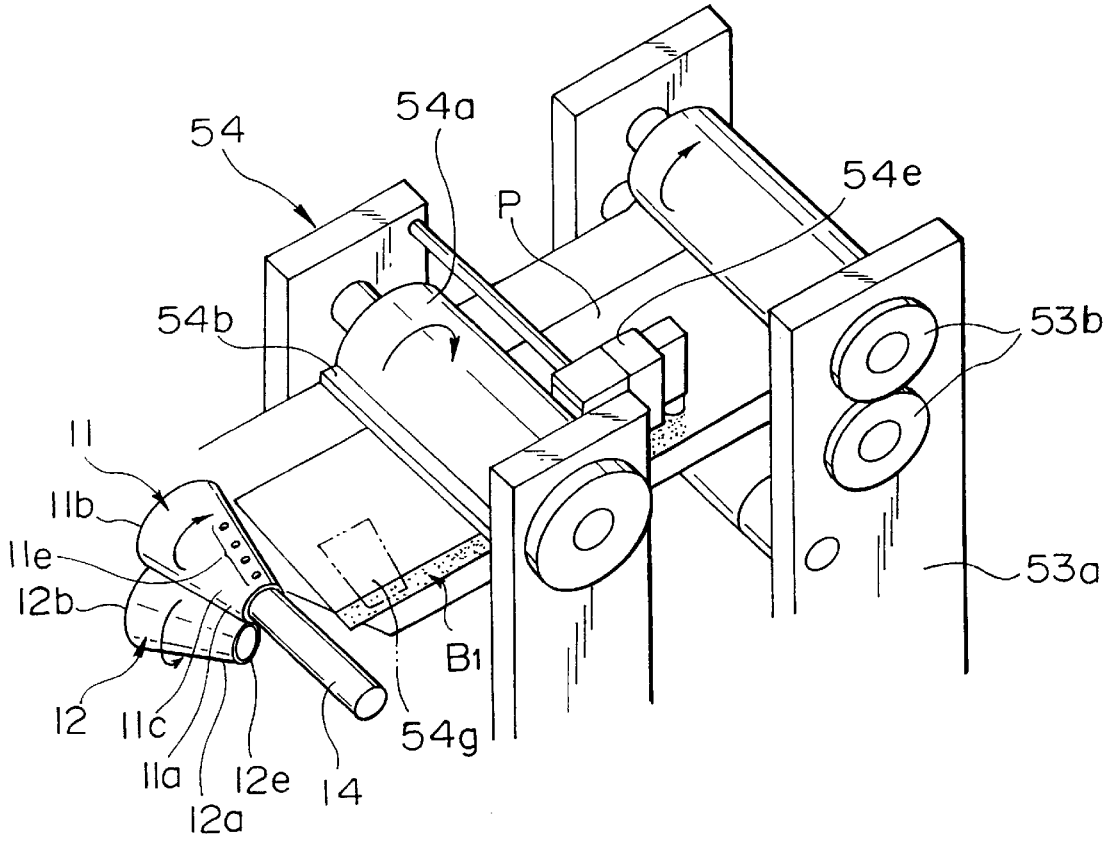
FIG. 11 is a perspective view showing the forming and holding cone rolls and the cutter means in the apparatus shown in FIG. 10.
Figure 12:
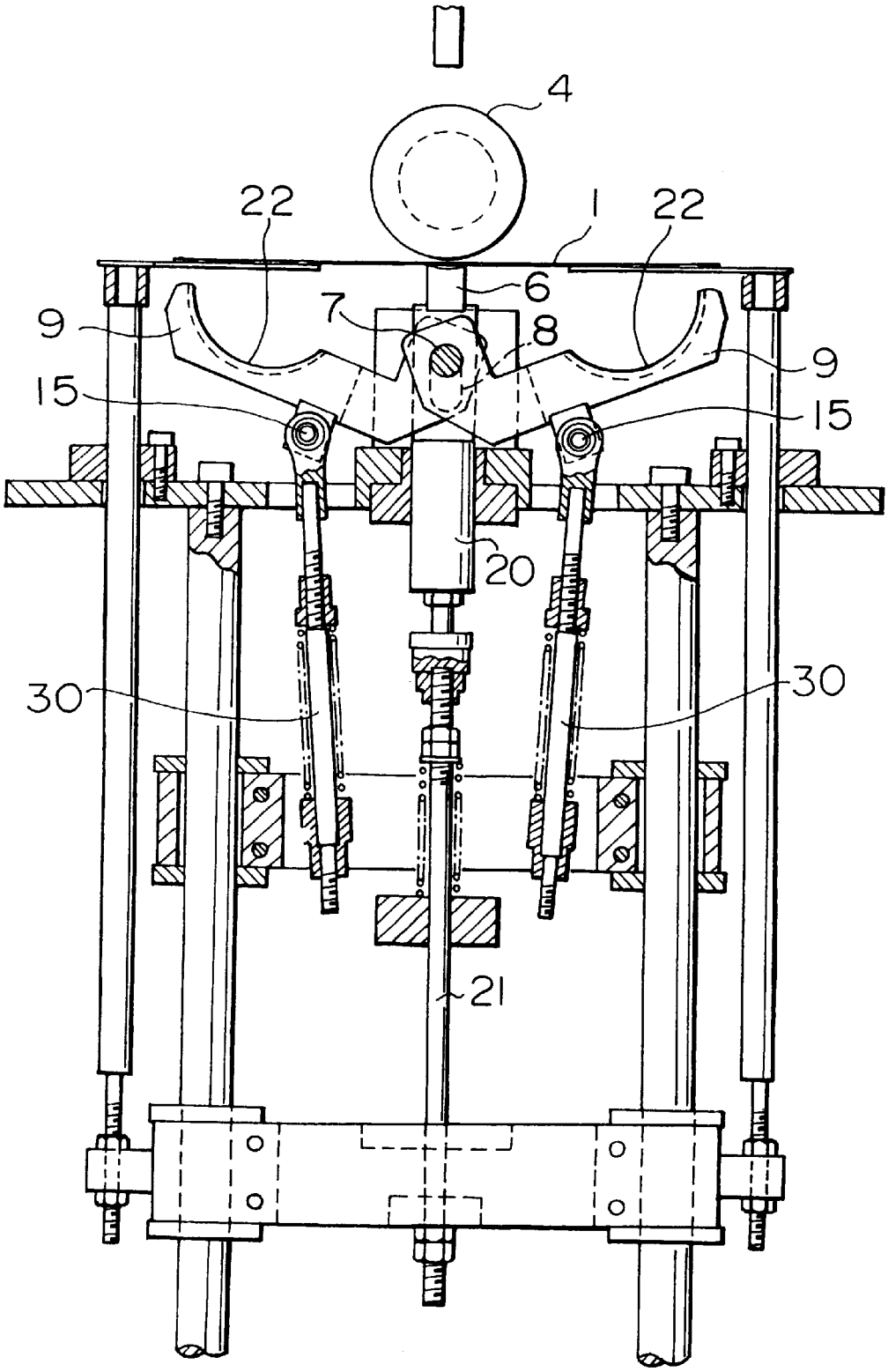
FIG. 12 PRIOR ART
FIG. 12 is a front view of a conventional side wall forming machine for making a cupped cake cup.
Figure 13A:
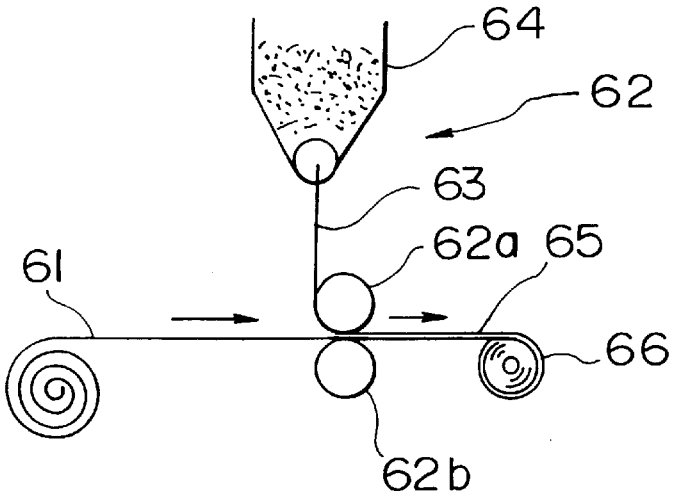
FIG. 13A PRIOR ART
FIG. 13(A) is a side view showing a device for producing a polyethylene paper.
Figure 13B:
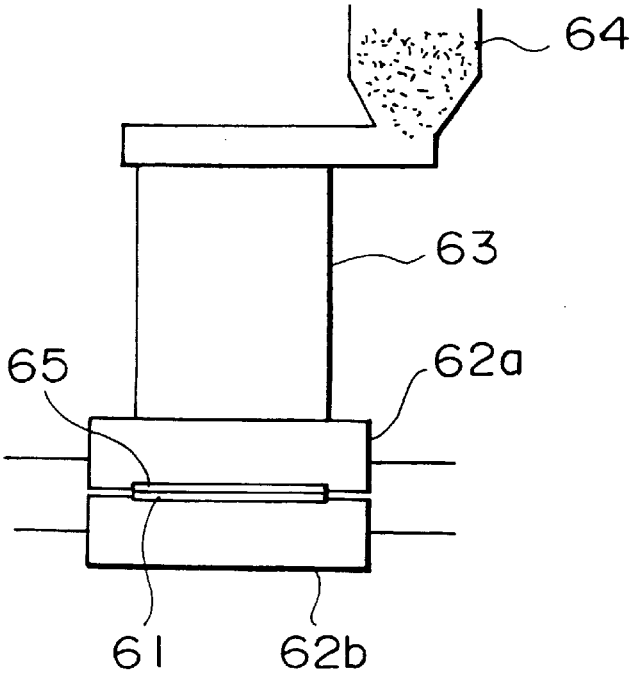
FIG. 13B PRIOR ART
FIG. 13(B) is a front view showing the device shown in FIG. 13(A).

FIG. 10 is a perspective view showing an entire production apparatus, and FIG. 11 shows a part of the production shown by FIG. 10 but it rather shows an improved drying means. The structural features and the operation thereof used is explained in the foregoing paragraphs as a production means, but it becomes more clearer as shown in perspective view than shown in plan view and side view, so we will explain the production apparatus with reference to FIGS. 10 and 11. Numeral 50 in FIG. 10 shows entire of the production apparatus, while the numeral 51 is a bed disposed on the floor on the entire surface of which are disposed almost all of the production apparatus and only a part of them are disposed on the extension thereof but all of them may be disposed on the bed. Numeral 52*a* is a paper P for making a cup or cups and they are clamped by a pair of nip rolls 53*b* supported by a supporting plate 53*a* and is driven by a clutch and brake received in speed controlling and a motor not shown and is also received in the velocity controlling means and is paid off in the direction shown in an arrow mark.

Numeral 54 is a cutter means disposed in the downstream side of the paper paying off means 52. The paper paid off is cut by a paper cutter 54*b* disposed right angle to the direction of feeding as a blank B1 for making one cup as shown by FIG. 5(B) and is sent to the roll gap formed by the conical cone roll 11 and holding cone roll 12 capable of approaching and leaving away with each other on the side wall forming apparatus 55. Numeral 54*d* is a heater and the bifurcated hot air blowing pipe 54*f* is disposed between front side and rear side of the cutter roller 54*a*. Polyethylene is laminated over the entire surface to be used as a inner surface of the side wall of the cup, but it cannot be visible due to its transparency. When the paper P comes just in front of the cutter roller 54*a*, hot air is blown out from one of the pipe and the polyethylene is fused and when the paper P pass over the cutter roller 54*a* another hot air is blown from the other pipe 54*f* and the polyethylene is fused fully and fed to the forming process and the forming work as a side wall and the sealing is completed at the same time. Numeral 54*e* in FIG. 11 shows a glue gun used for spraying glues which takes a considerably longer time for its drying and is used in front of the upstream side of the cutter roller, but it is used not to spray glue at the portion to the place where the spray gun contact with the paper cutter 54*b*. In FIG. 11 the place 54*g* shown by two dash and actual line in front of the forming roll 11 is the place where the sealing means is used which uses hotmelt heated and melted. In FIG. 10, 56 is a stacking means which stacks 50 to 200 of formed side walls as already mentioned and this stacking means 56 is the same as that used for bottomed cups such as used for ice-cream cones and are out of the present invention and may be of any arbitrary one.

The present invention cuts the rolled paper stock from its forwarding end as its one piece of the paper cup and supplies it between the frusto-conical forming roll rotating at a high speed and the holding frusto-conical holding rolls having the same inclination angle as the forming roll and approaches towards and leaves away from the forming roll. During one rotation of the two rolls, these two rolls finish its forming and gluing of hollow frusto-conical paper stock, and then separating it to the holding cone roll from the forming roll, then by the air blowing from the air sucking and exhausting hole opened on the forming cone roll and by the air blown from the auxiliary air nozzle, the side wall of the formed paper is completely separated from the forming cone roll, thereby it becomes possible to continuously and in high speed the motion of stacking the formed side wall of the paper cones on the small diameter side of the axial diameter side of the forming cone roll. As it becomes possible to form paper cups by the present invention at a speed more than ten times of the prior art hinge type reciprocal means, it contributes greatly to improve the productibility. The present invention is also applicable to the method and apparatus for supplying a previously cut fan shaped cup between the forming roll and the holding roll.

What is claimed is:

1. A method of forming a side wall of a cupped cake cup at high speed, comprising the steps of:

paying off a paper sheet through a plurality of paying off rolls;

cutting a blank off the paper sheet with a paper cutter disposed at least one of normal and oblique to a direction in which the paper sheet is fed;

immediately before or after the cutting, applying a sealing agent;

supplying the blank to a specified roll gap formed between a forming cone roll and a holding cone roll capable of rotating in opposite directions;

performing shaping, cutting and sealing works on the blank during one rotation of the forming and holding cone rolls, wherein the blank is made into the side wall of the cupped cake cup;

separating the side wall of the cupped cake cup from the forming cone roll; and guiding the side wall in an axial direction of said forming cone roll.

2. A method as claimed in claim 1, further comprising the steps of:

laying the blank on a stacking board;

taking up the blank, moving the blank immediately before a side wall forming station including the forming cone roll and the holding cone roll at a specified angle with each other, and applying the sealing agent to the blank;

while rotating both the forming cone roll and the holding cone roll in the opposite directions, positioning the forming cone roll and the holding cone roll to a place where the blank is fed;

approaching said holding cone roll toward the forming cone roll to form the specified roll gap when a plurality of sucking and exhausting holes provided on said forming cone roll reaches at an approaching point where the specified roll gap is to be formed;

supplying said blank to the specified roll gap by placing a forwarding end tip of the blank over said sucking and exhausting holes and holding the blank against the forming cone roll with the holding cone roll and suction of said sucking and exhausting holes; and while urging said blank toward a side periphery of the forming cone roll, overlapping and sealing the forwarding tip end of the blank with a rear tip end of the blank.

3. A method as claimed in claim 2, further comprising the steps of:

separating said holding cone roll from the forming cone roll and blowing air from said sucking and exhausting holes when the sealing is finished;

moving the blank to a small diameter side of the forming cone roll by blowing air to an inner side of the blank from a large diameter side of the forming cone roll by an auxiliary air nozzle; and preparing a next blank ready to be supplied to said specified roll gap between said forming cone roll and said holding cone roll.

4. A method as claimed in claim 1, further comprising the steps of:

positioning the paper sheet with a face which is to become an inside face of the cupped cake cup facing up;

clamping the paper sheet between a pair of nip rolls and sending the paper sheet to the paper cutter at a predetermined speed;

cutting the blank into a fan shape wherein one side edge of the fan shape is parallel to a cutting line and the blank is cut to a size of one cup by the paper cutter;

placing the blank between a plurality of sucking and exhausting holes provided on said forming cone roll and said holding cone roll;

holding said blank against said forming cone roll by sucking air from the sucking and exhausting holes;

while urging said blank against said forming cone roll by said holding cone roll and sucking air from the sucking and exhausting holes, winding the blank around a side peripheral face of said forming cone roll; and while rotating said forming cone roll and said holding cone roll the one rotation, cutting a small diameter end and a large diameter end of the blank into a desired shape, respectively, by a lower end cutter and an upper end cutter.

5. A method as claimed in claim 1, wherein the blank is cut during the rotating such that an upper opening portion of the blank has at least one of a petal-like configuration and a wave-like configuration by using at least one of a petal like cutter and a wave-like cutter, respectively, urged against the forming cone roll.

6. A high speed production apparatus for making a side wall of a cupped cake cup, comprising:

a blank stocker positioned and configured to receive a plurality of fan shaped blanks in a stacked state;

a forming cone roll having a frusto-conical configuration rotatable around a rotating axis and having a plurality of sucking and exhausting holes arrayed in a line along the rotating axis;

a holding cone roll positioned parallel to said forming cone roll, configured to approach toward the forming cone roll to form a desired distance from the forming cone roll and configured to rotate in an opposite direction to the forming cone roll, wherein said sucking and exhausting holes urge said blank wound around a peripheral face of the forming cone roll by suction, and the forming cone roll and the holding cone roll shape the blank into the side wall of the cupped cake cup having a small diameter side end and a large diameter side end of a specified dimension in one rotation of the forming cone roll.

7. A high speed production apparatus as claimed in claim 6, further comprising:

a transporting device positioned between said blank stocker and the forming cone roll and configured to apply a sealing agent to the blank and to transport the blank to the forming cone roll;

an auxiliary air nozzle disposed and configured to blow air toward the blank to separate from the forming cone roll and move toward the small diameter side of the forming cone roll as said sucking and exhausting holes exhaust air to release the blank from the forming cone roll.

8. A high speed production apparatus as claimed in claim 6, further comprising a plurality of at least one of petal-like cutters and wavy cutters positioned at a lower end and an upper end of the holding cone roll to cut the blank into the side wall of the cupped cake cup with a concave and convex pattern.

9. A high speed production apparatus as claimed in claim 6, further comprising:

a pair of nip rolls supported by opposing supporting plates and configured to receive and pay off a paper sheet; and a paper cutter disposed in the downstream of the pair of nip rolls and configured to cut the blank from the paper sheet.

10. A high speed production apparatus as claimed in claim 7, further comprising a decorative petal cutter configured to rotate around a rear end of the forming cone roll and cut the blank into the side wall of the cupped cake cup having a decorated edge portion.

11. method as claimed in claim 1, wherein said sealing agent comprises a glue.

12. A method as claimed in claim 1, wherein said sealing agent comprises a hot melt sealing.

13. An apparatus for high speed production of a side wall for a cupped cake cup, comprising:

a paper cutter disposed and configured to cut a blank from a paper sheet;

a transport device configured to receive the blank from the cutter, apply a sealing agent to the blank and transport the blank;

a forming cone roll having a frusto-conical configuration, configured to rotate around a rotating axis and having a plurality of sucking and exhausting holes arrayed in a line along the rotating axis, said sucking and exhausting holes being configured to hold the blank against the forming cone roll by suction and releasing the blank by exhaustion;

a holding cone roll positioned and configured to approach toward the forming cone roll to form a gap for receiving the blank and hold the blank against the forming cone roll while the forming cone roll makes one rotation, wherein the blank is formed into the side wall of the cupped cake cup while the forming cone roll makes the one rotation.

14. An apparatus as claimed in claim 13, further comprising at least one decoration cutter provided on the holding cone roll and configured to cut the blank into the side wall of the cupped cake cup having decorated edge portions.

15. An apparatus as claimed in claim 13, further comprising an auxiliary air nozzle configured to blow air toward the blank wherein said auxiliary air nozzle blows the blank along the rotation axis after the forming cone roll completes the one rotation.

16. A method as claimed in claim 11, wherein said sealing agent is selected from the group consisting of a thermally plastic resinous material, a water soluble starch, polyethylene, and a combination thereof.

* * * * *